US005158523A

United States Patent [19]

Houk et al.

[11] Patent Number: 5,158,523

[45] Date of Patent: Oct. 27, 1992

[54] APPARATUS FOR ENHANCED EMBOSS BONDING OF MULTI-PLY TISSUE PRODUCTS

[75] Inventors: Curtis J. Houk, Keystone Heights, Fla.; Edward Giesler, Little Suamico, Wis.

[73] Assignee: James River Corporation of Virginia, Richmond, Va.

[21] Appl. No.: 583,648

[22] Filed: Sep. 17, 1990

[51] Int. Cl.[5] ..... B31F 1/07

[52] U.S. Cl. ..... 493/396; 493/402; 493/403; 493/355

[58] Field of Search ..... 493/381, 384, 401–403, 493/464, 346, 350, 351, 355, 390, 392, 394; 83/875, 879, 886, 887

[56] References Cited

U.S. PATENT DOCUMENTS

| | | | |
|---|---|---|---|
| 1,657,591 | 1/1928 | Schlender | 493/464 |
| 1,929,924 | 10/1933 | Jopson . | |
| 2,729,267 | 1/1956 | Walton . | |
| 2,890,540 | 6/1959 | Britt . | |
| 3,323,983 | 6/1967 | Palmer . | |
| 3,544,420 | 12/1970 | Murphy et al. . | |
| 3,580,797 | 5/1971 | Asmuth . | |
| 3,834,286 | 2/1975 | Nystrand . | |
| 3,867,872 | 9/1974 | Nystrand . | |
| 4,759,967 | 7/1988 | Bauernfeind . | |

FOREIGN PATENT DOCUMENTS 8503029 7/1985 PCT Int'l Appl. .

*Primary Examiner*—Bruce M. Kesliuk
*Assistant Examiner*—Jack Lavinder
*Attorney, Agent, or Firm*—Finnegan, Henderson, Farabow, Garrett & Dunner

[57] ABSTRACT

An apparatus for emboss bonding two or more light-weight cellulosic webs to form a multi-ply article, the apparatus including a first cylindrical roll having a metal surface and being disposed for rotation about a cross machine rotation axis, an etched area of the surface of the first roll defining a pattern having pedetermined dimensions for forming proximate the perimeter of the article an emboss bond, the etched area comprising a plurality of truncated right rectangular pyramidal cavities in the roll surface disposed in adjacent relationship in the machine direction and the cross machine direction, and a second cylindrical roll disposed to co-operatively rotate with the first roll and to define therewith a nip for engaging the webs, the second roll having an impressionable surface capable of conforming under pressure to the etched area or having an etched area defining a complementary pattern for meshing engagement with the etched area on the first roll.

21 Claims, 10 Drawing Sheets

APPARATUS FOR ENHANCED EMBOSS BONDING OF MULTI-PLY TISSUE PRODUCTS

BACKGROUND OF THE INVENTION

1. Field of the Invention

This invention relates to the apparatus and method for emboss bonding multi-ply tissue products and to the resultant product.

2. Description of Related Art

It is well-known to emboss bond multiple plies of lightweight cellulosic material to form tissue products such as napkins. The use of emboss bonding of the periphery of such products not only secures the multiple plies together but also provides a decorative pattern frequently referred to as "coin edge." Examples of apparatus and methods for emboss bonding multi-ply paper products are disclosed in Nystrand, U.S. Pat. Nos. 3,867,872 and 3,834,286; Asmuth, U.S. Pat. No. 3,580,797; Palmer et al., U.S. Pat. No. 3,323,983; Walton, U.S. Pat. No. 2,729,267; and Jopson, U.S. Pat. No. 1,929,924.

The subject invention improves upon known emboss bonding apparatus and methods by providing emboss bond having traditional coin edge emboss appearance with improved bonding strength.

Additional advantages of the invention are set forth in part in the description which follows, and in part will be obvious from the description, or may be learned by practice of the invention.

SUMMARY OF THE INVENTION

The objects and advantages of the invention may be realized and obtained by means of the instrumentalities and combinations particularly pointed out in the appended claims.

In accordance with the invention as broadly described herein, an apparatus for emboss bonding two or more lightweight cellulosic webs to form a multi-ply article comprises a pair of rolls disposed for cooperative rotation about parallel cross machine axes and defining a nip between the surfaces thereof and means on the cooperating surfaces of the rolls for forming on webs introduced into the nip an emboss pattern comprising a plurality of truncated right rectangular pyramids projecting from one surface of the webs in aligned adjacent relationship in the machine direction (MD) and the cross machine direction (CD).

Preferably one roll has a metal surface and the forming means comprises an etched area on the surface of the one roll having predetermined dimensions and comprising a plurality of truncated right rectangular pyramidal cavities in said roll surface disposed in adjacent CD and MD relationship.

In one preferred embodiment the other roll has an impressionable surface capable of conforming under pressure to the etched area.

In another preferred embodiment the other roll has a metal surface including a cooperating etched area having the predetermined dimensions, the cooperating etched area comprising a plurality of truncated right rectangular pyramids projecting from the surface of the other roll for meshing engagement with the cavities in the surface of the one roll.

Preferably, each cavity in the surface of the one roll is defined by an axis coaxial with a radius of the roll, a base defining an opening in the surface of the roll, a generally planar apex axially spaced from the base and generally perpendicular to the axis, and sidewalls extending between the base and the apex, the apex having a CD dimension in the range of about 0.025" to about 0.050", a MD dimension in the range of about 0.020" to about 0.050" and a MD/CD dimension ratio of at least about $\frac{2}{3}$, the axial distance between the base and the apex being in the range of about 0.010" to about, 0.012", and the sidewalls diverging from the apex at an angle to the axis in the range of about 25° to about 40° .

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

Reference will now be made in detail of the present preferred embodiments of the invention, examples of which are illustrated in the accompanying drawings.

In accordance with the invention, as embodied and broadly described herein, an apparatus for emboss bonding two or more lightweight cellulosic webs to form a multi-ply article comprises a pair of rolls disposed for cooperative rotation about parallel cross machine axes and defining a nip between the surfaces thereof.

Figure 1:
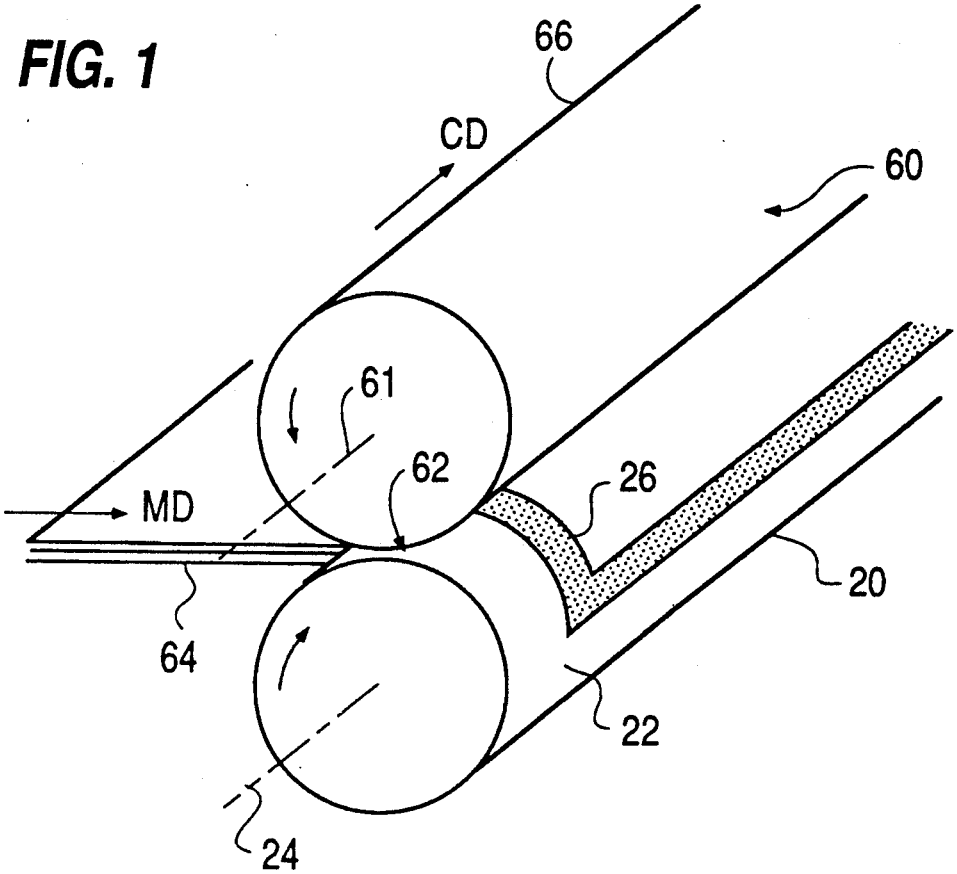
FIG. 1 is a perspective view of an embodiment of the apparatus in accordance with the invention.
Figure 3:
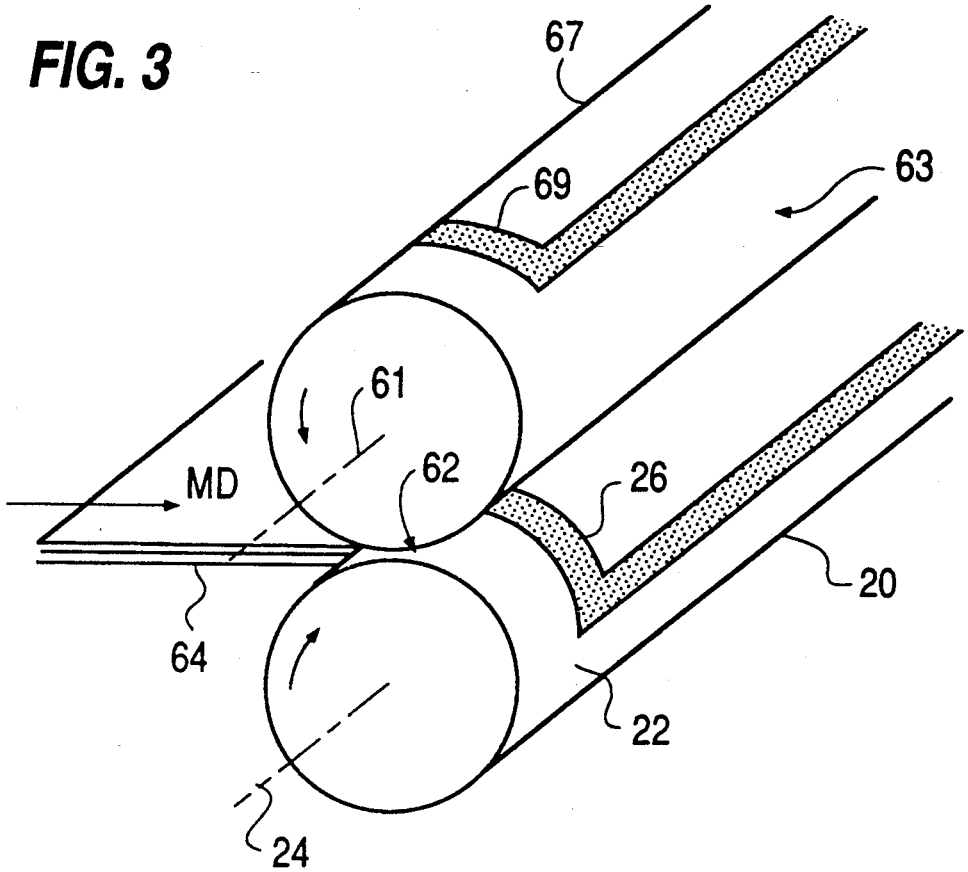
FIG. 3 is a perspective view of another embodiment of the apparatus in accordance with the invention.

As depicted in FIGS. 1 and 3, the apparatus comprises first roll 20 and second roll 60 disposed for cooperative rotation about parallel cross machine axes 24, 61 and defining a nip 62 between the surfaces of rolls 20, 60.

In accordance with the invention, the apparatus includes means on the cooperating surfaces of the rolls for forming on webs introduced into the nip an embossed pattern comprising a plurality of truncated right rectangular pyramids projecting from one surface of the webs in aligned adjacent relationship in the machine direction (MD) and the cross machine direction (CD).

In the preferred embodiments depicted in FIGS. 1 and 3, first roll 20 has a metal surface 22 and the forming means comprises an etched area 26 in the surface of first roll 20. Etched area 26 has predetermined dimensions selected to define an embossed bond pattern on an article formed from webs 64 introduced into nip 62. Etched area 26 comprises a plurality of truncated right rectangular pyramidal cavities 28 in surface 22 of roll 20, the cavities being disposed in adjacent relationship in the MD and CD directions.

Preferably, as depicted in FIGS. 2 and 5–8, cavities 28 are immediately adjacent each other in the cross machine and machine directions defining essentially a knife edge between the cavities. While this is believed to be ideal, certain factors may require spacing between adjacent cavities depending upon the web being emboss bonded, the required pressure of emboss bonding and other production factors affecting the ability to efficiently manufacture multi-ply articles without unacceptable damage such as excessive cutting of webs 64 or cutting of the surface of the opposed roll. To avoid these problems some spacing between adjacent cavities on the order of about 0.003" to about 0.006" may be necessary. Additionally, spacing between adjacent cavities may be imposed due to limitations on engraving technology.

Preferably each cavity 28 is defined by an axis 30 coaxial with a radius of first roll 20, a base 32 defining an opening in surface 22 of first roll 20, a generally planar apex 34 axially spaced from base 32 and generally perpendicular to axis 30, and sidewalls 36, 38 extending between base 32 and apex 34. Preferably, apex 34 has a cross machine direction (CD) dimension 40 in the range of about 0.025" to about 0.050", a machine direction (MD) dimension 42 in the range of about 0.020" to about 0.050" and a MD/ CD dimension ratio of at least about $\frac{2}{3}$. Preferably, the axial distance 44 between base 32 and apex 34 is in the range of about 0.010" to about 0.012", the axial distance 44 in the machine direction being in fact slightly less than in the cross machine direction since roll surface 22 curves in the machine direction. Sidewalls 36, 38 preferably diverged from apex 34 at an angle 46, 48 to axis 30 in the range of about 25 degrees to about 40 degrees.

The shape and dimensions of cavities 28 are selected to generate greater bonding pressure in the emboss bond area for a given pressure between the surface of the first roll and a cooperating roll. This is achieved by having sidewalls at a relatively steep angle which generates greater pressure in the sidewall portions of the impressions formed in the emboss bonding area. Moreover, the relatively small size of each cavity permits a greater number of such cavities per given area of bond resulting in a greater bond area. The relatively short distance between the apex and base of the cavity reduces stretching of the web as it is deformed into the cavity.

In a preferred embodiment, each cavity has an apex having a CD dimension 40 of about 0.027" and an MD dimension 42 of about 0.02", an axial distance 44 between apex 34 and base 32 of about 0.012", an angle 46 between axis 30 and cross machine direction walls 36 of about 40 degrees, and an angle 48 between axis 30 and machine direction walls 38 of about 25 degrees.

Since increasing the number of cavities 28 in etched area 26 increases the bonding area for a given emboss area, preferably the combined area of the apices 34 of cavities 28 is at least about 30% of the total area of etched area 26 which is also the area of the emboss bond imposed on the multi-ply article.

The pattern of etched area 26 is generally selected to define an emboss bond proximate the perimeter of the multi-ply article and the total area of the emboss bond determines the strength of the bond with respect to any particular article. Accordingly, the area of the emboss bond in a particular article is predetermined based upon the size of the article and the number and weight of the cellulosic webs forming the article. Preferably, therefore, the area of etch pattern 26 which forms the emboss bond is at least about 15 square inches per gram of article weight.

In a preferred embodiment, the etched area defines a rectangle having two parallel sides extending circumferentially on surface 22 of first roll 20 and two parallel sides extending on surface 22 of first roll 20 in the cross machine direction.

Figure 10:
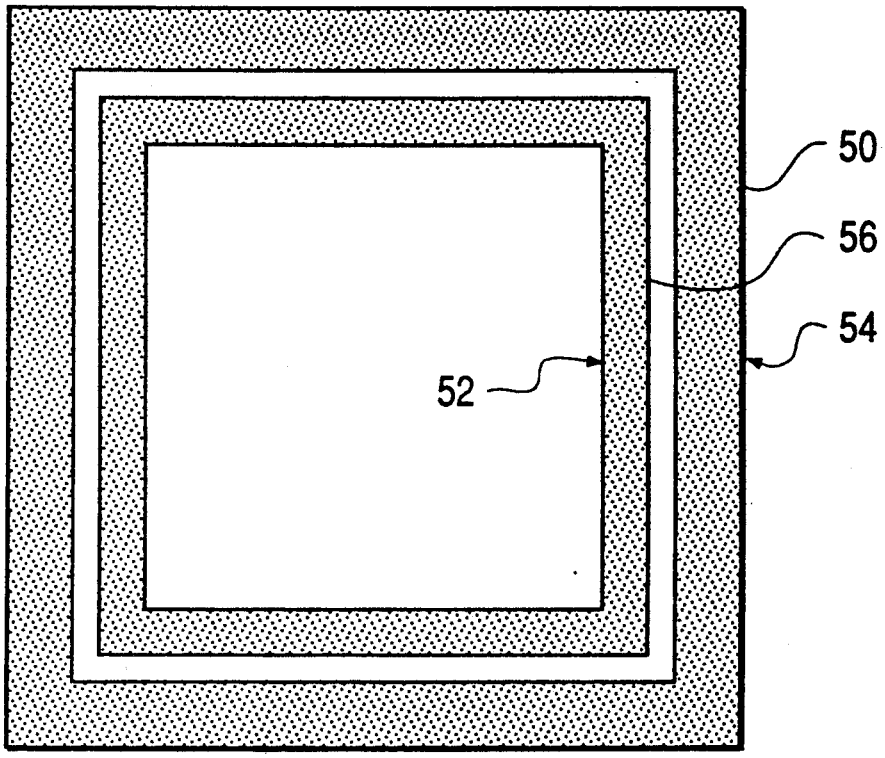
FIG. 10, is a plan view of one embodiment of the product manufactured using the apparatus of the invention.

While various placements and aesthetic dispositions of the emboss bond may be used in any multi-ply article, in a preferred embodiment, etched area 26 is disposed to form an emboss bond extending from the edge of an article a width in the range of about 0.25" to about 1.5". It may be preferred, as depicted in FIG. 10, for article 50 to have an emboss bond area comprising two parallel patterns 52, 54 having a space 56 therebetween of about 0.25". Naturally, to achieve such an emboss bond, pattern of cavities in etched area 26 would correspond.

Figure 2:
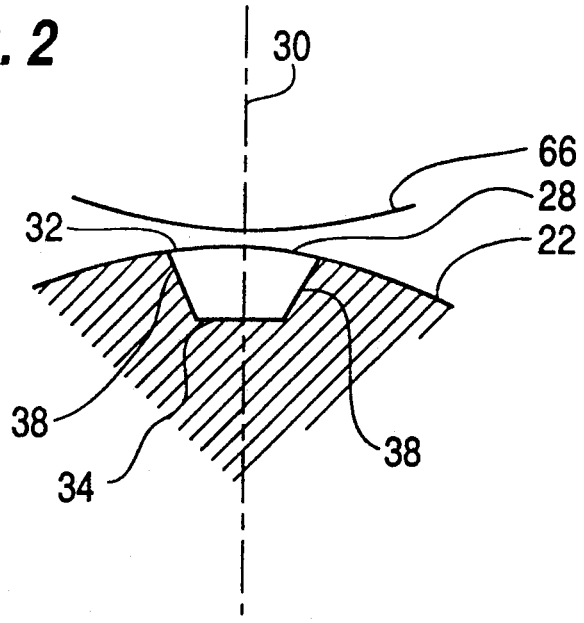
FIG. 2 is an enlarged, non-scale cross-sectional schematic view of one cavity of the emboss pattern of the apparatus of FIG. 1 and its relationship to the other roll prior to application of pressure.

In one preferred embodiment of the apparatus, depicted in FIGS. 1 and 2, second roll 60 has an impressionable surface 66 capable of conforming under pressure to the etched area.

Figure 9:
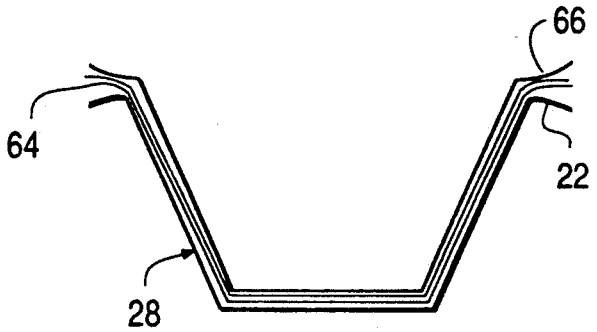
FIG. 9 is a schematic cross-sectional view of one cavity of the emboss pattern of the invention in mating relation with the imposed impressionable surface.
Figure 11:
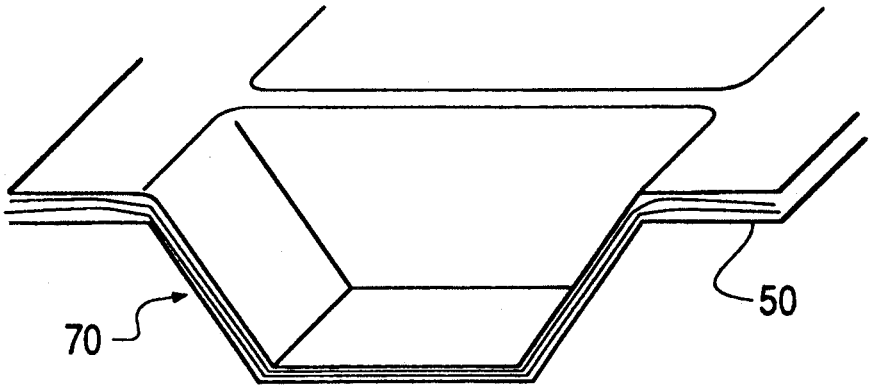
FIG. 11 is a cross-sectional perspective view of one impression in the emboss pattern of the product of FIG. 10 formed using the apparatus of the invention.

In operation, the first embodiment, as depicted in FIG. 9, pressure generated at nip 62 between rolls 20 and 60 will cause the impressionable surface 66 of roll 60 to deform and fill cavities 28 in the surface 22 of roll 20. The deformation of surface 66 of roll 60 will press webs 64 into cavity 28 creating an impression in the resulting multi-ply article. The impressions 70 (FIG. 11) in article 50, a plurality of which define the emboss area of article 50, generally conform to the size and shape of cavities 28.

Figure 4:
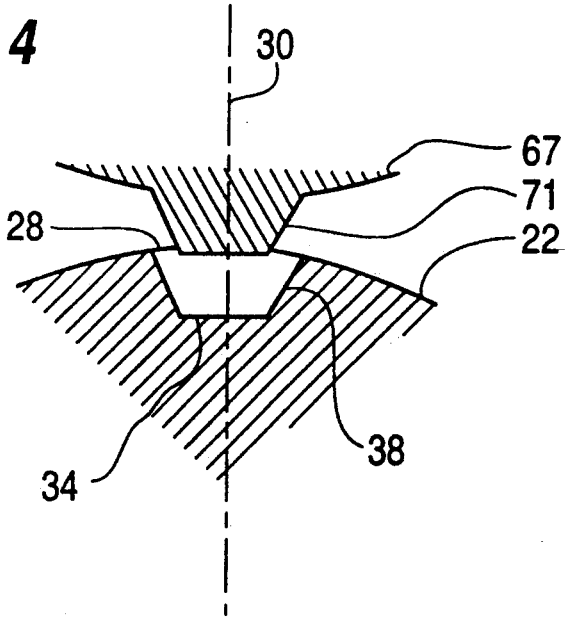
FIG. 4 is an enlarged, non-scale cross-sectional schematic view of one cavity of the emboss pattern of the apparatus of FIG. 3 and its relationship to the mating pyramid projecting from other roll prior to application of pressure.
Figure 5:
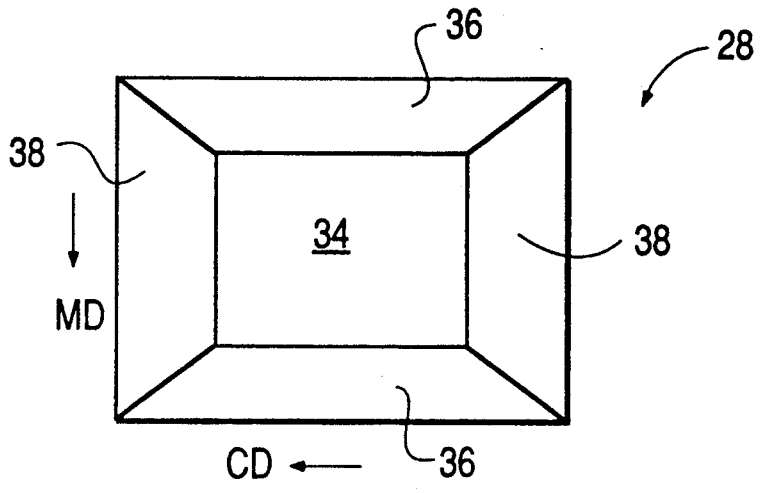
FIG. 5 is a plan view of one cavity of the emboss pattern of the invention.
Figure 6:
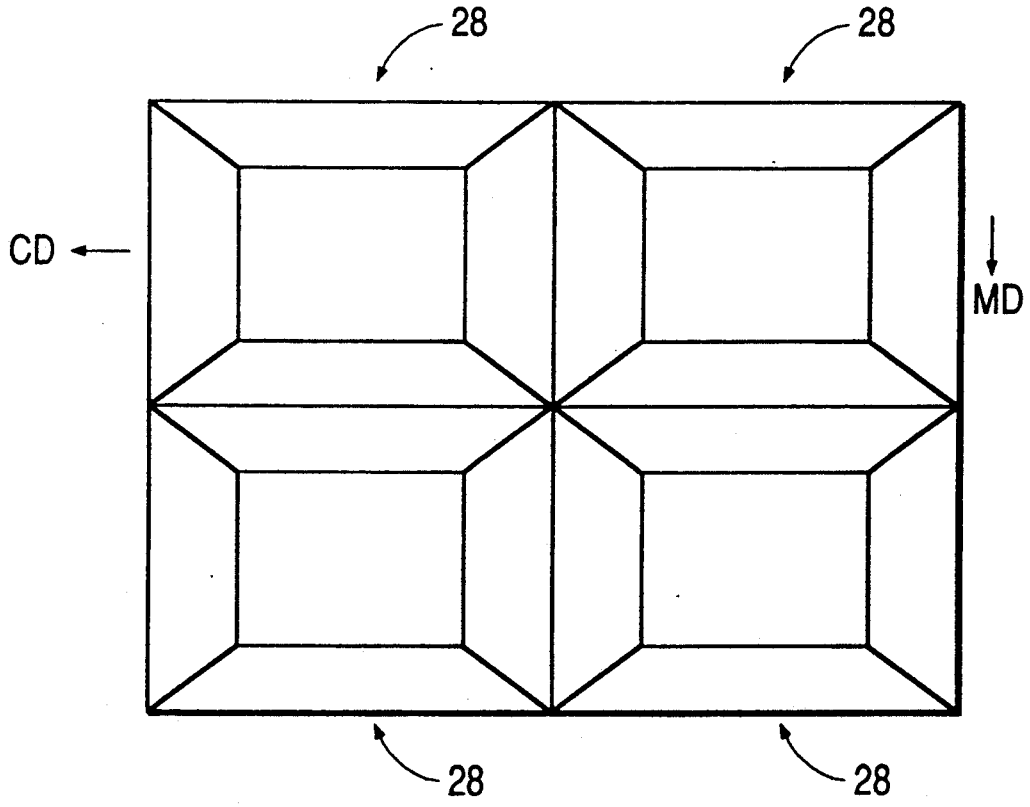
FIG. 6 is a plan view of four cavities of the emboss pattern of the invention.
Figure 7:
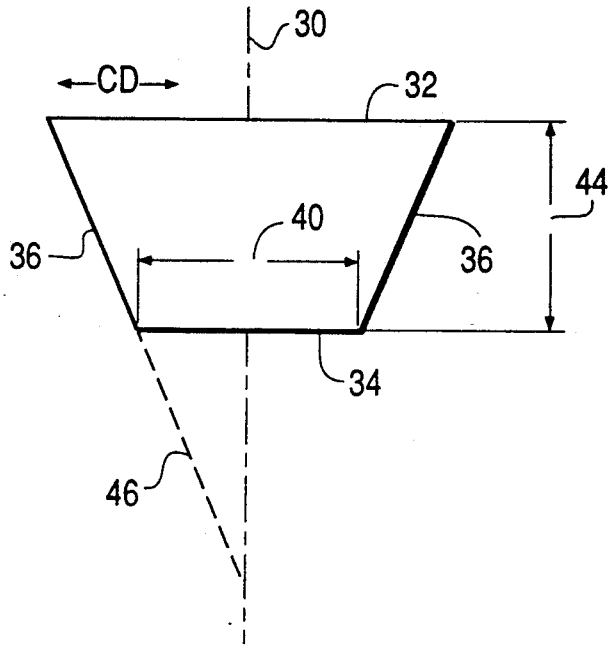
FIG. 7 is a schematic cross-sectional view depicting the dimensions of a cavity of the emboss pattern of the invention in the cross machine direction.
Figure 8:
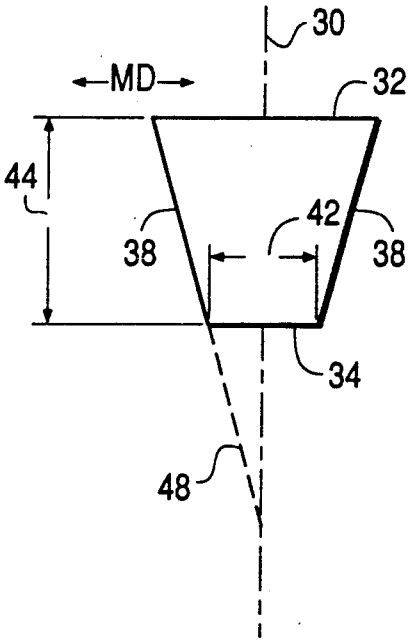
FIG. 8 is a schematic cross-sectional view depicting the dimensions of a cavity, of the emboss pattern of the invention in the machine direction.

In an alternative embodiment, depicted in FIGS. 3 and 4, second roll 63 has a metal surface 67 including a cooperating etched area 69 having substantially the same predetermined dimensions as etched area 26. Cooperating etched area 69 comprises a plurality of truncated right rectangular pyramids 71 projecting from surface 67 of roll 63 for meshing engagement with cavities 28 in surface 22 of first roll 20. The shape and dimensions of pyramids 71 correspond to the cavities to which they are to mesh. Thus, the description above with respect to FIGS. 5-8 apply as well to pyramids 71, except of course that the apices of the pyramids are spaced radially outwardly from the roll surface and the bases of the pyramids are not holes in the surface of the roll. The bases of the pyramids 71 preferably form an inverted knife edge.

The advantages of the invention over apparatus incorporating known embossing patterns are demonstrated by the graphs in FIGS. 12–15. The graphs represent tests performed comparing the etched pattern of the subject invention (pattern #8204) against commercially available coin edge patterns and some other prototype test patterns. All tests were performed by pressing 2 ply, 11 lb./3000 ft. $^2$ basis weight cellulosic material between a hardened steel engraving of the pattern and a conventional fiber filled roll. All tests were run at a pressure of 200 lbs. of force per linear inch of pattern width in the cross machine direction.

Figure 12:
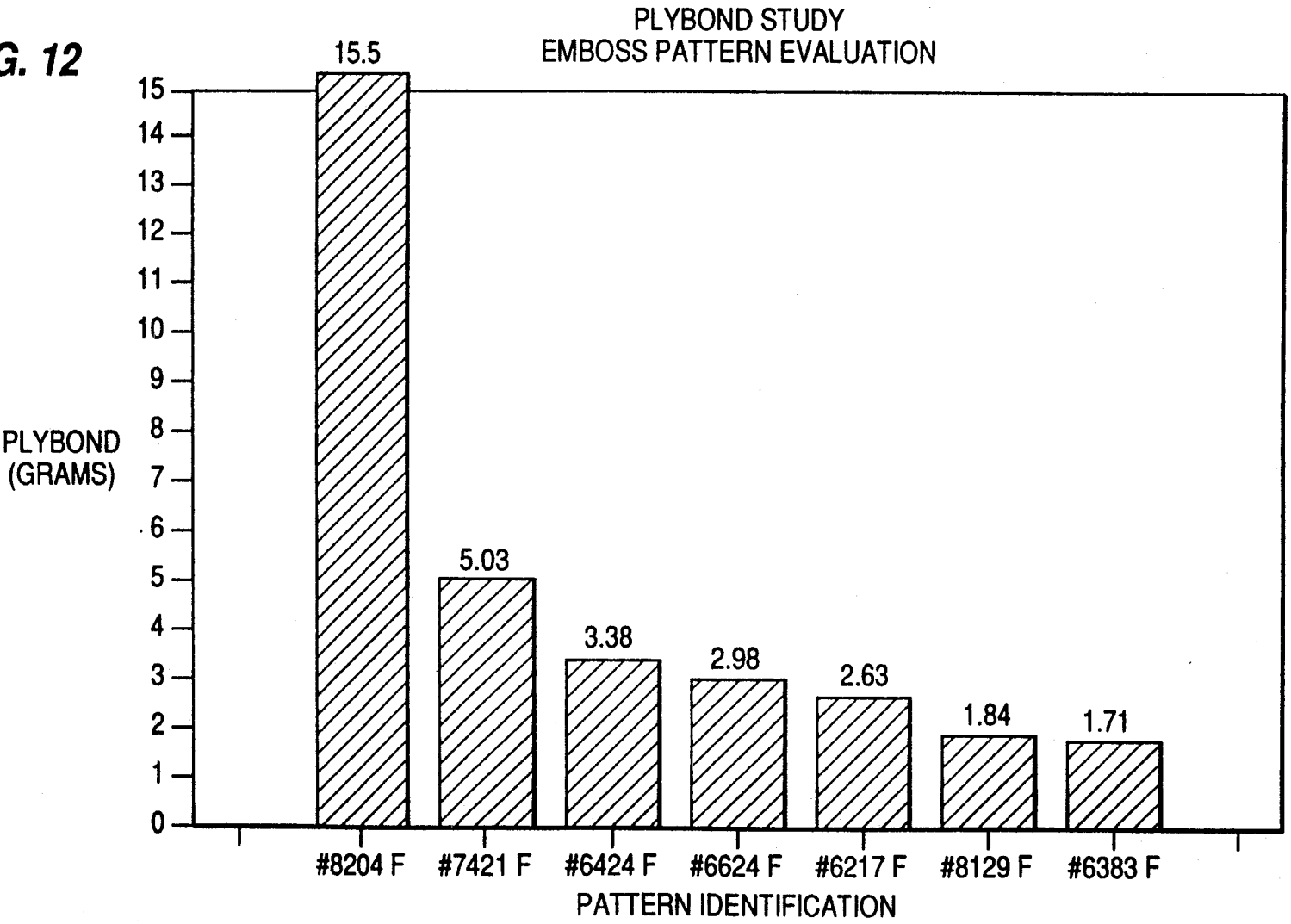
FIGS. 12, 13, 14, 15 and 16 are graphic representations comparing the strength of the bond formed in accordance with the invention with bonds formed using other emboss patterns.

FIG. 12 represents the results of tests of the pattern of the invention (#8204) against 6 hardened steel engravings of patterns of commonly employed coin edge emboss bonds. The experiment was conducted by mechanically pressing each hardened steel engraving into a conventional fiber filled roll, the same fiber filled roll was used for each pattern to maintain consistent conditions. In each case the engraving was female, that is, the etched area comprised cavities. Ten samples of the 2-ply napkin stock were passed through the nip of each coin edge emboss pattern. Although every attempt was made to maintain a constant nip pressure for each of the patterns, pressure sensitive film was also used to measure the actual pressure applied to each of the emboss patterns evaluated. The ply bond strength of each emboss sample was determined using James River Ply Bond Test Method M-082. This ply bond data was then normalized for pressure using the data collected from the pressure sensitive tape. FIG. 12 represents the results of those tests and demonstrates the clear superiority of pattern #8204 in terms of ply bond strength.

Figure 13:
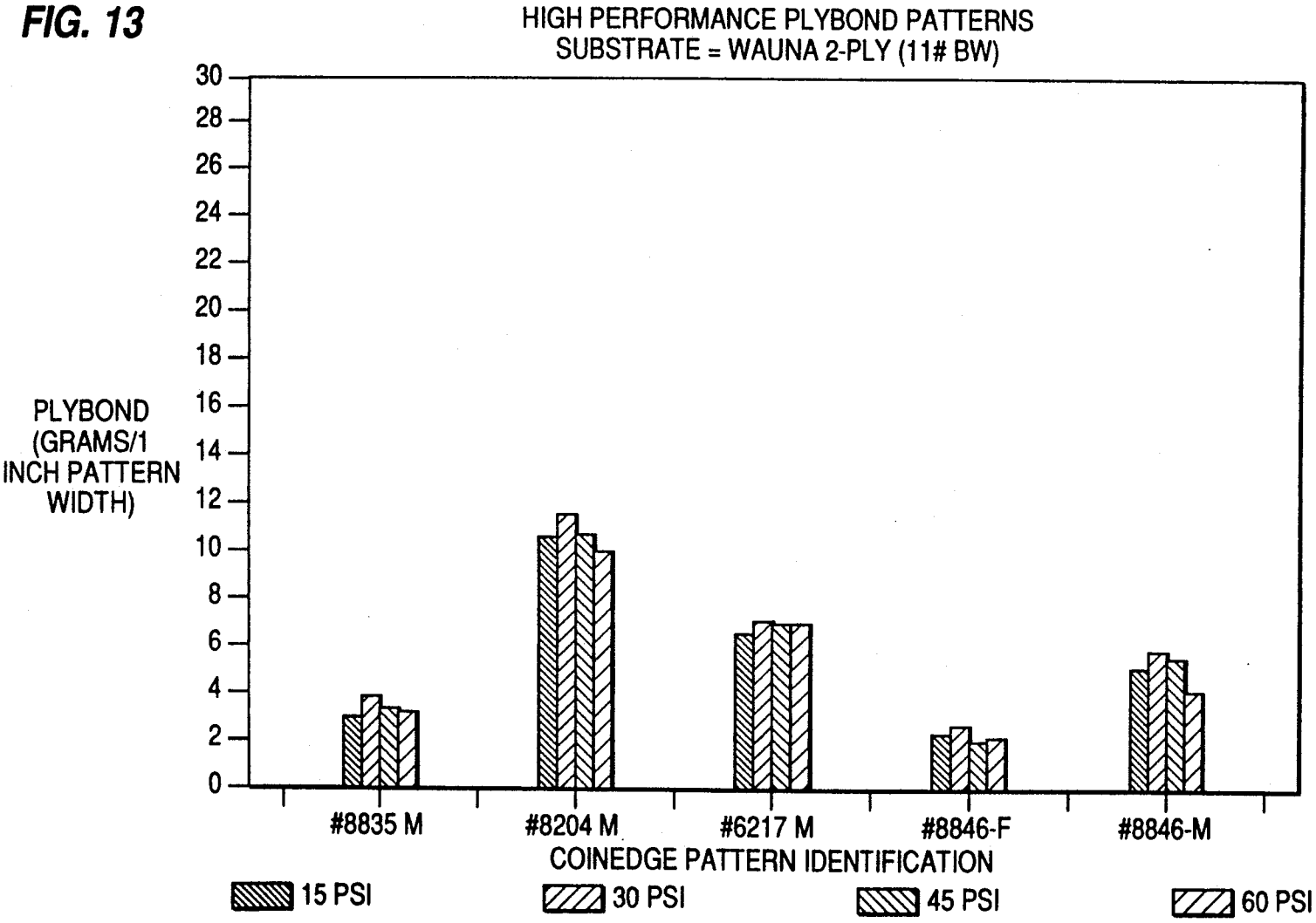

The second test represented by FIG. 13 compared pattern #8204 against other prototype test patterns and pattern #6217, a commercially available ply bonding pattern used also in the test for FIG. 12. In this test all patterns were engraved on the same steel roll so that the pressure applied during testing was exactly the same for all patterns. All the patterns in this test, except for #8846F, were male patterns wherein the etched area comprised projections from the roll surface impressed into an impressionable surface; both male and female versions of pattern 8846 were tested. The steel engraved roll was pressed into a conventional fiber filled roll and 6 samples of 2-ply napkins stock were passed through the nip of each coin edge emboss pattern. The ply bond strength of each sample was determined using James River Test Method M-082. FIG. 13 represents the results of those test and clearly demonstrates the superiority of the male version of the pattern of the invention as represented by pattern #8204 as opposed to the male version of commercially available pattern #6217 and other prototype test patterns.

Figure 14:
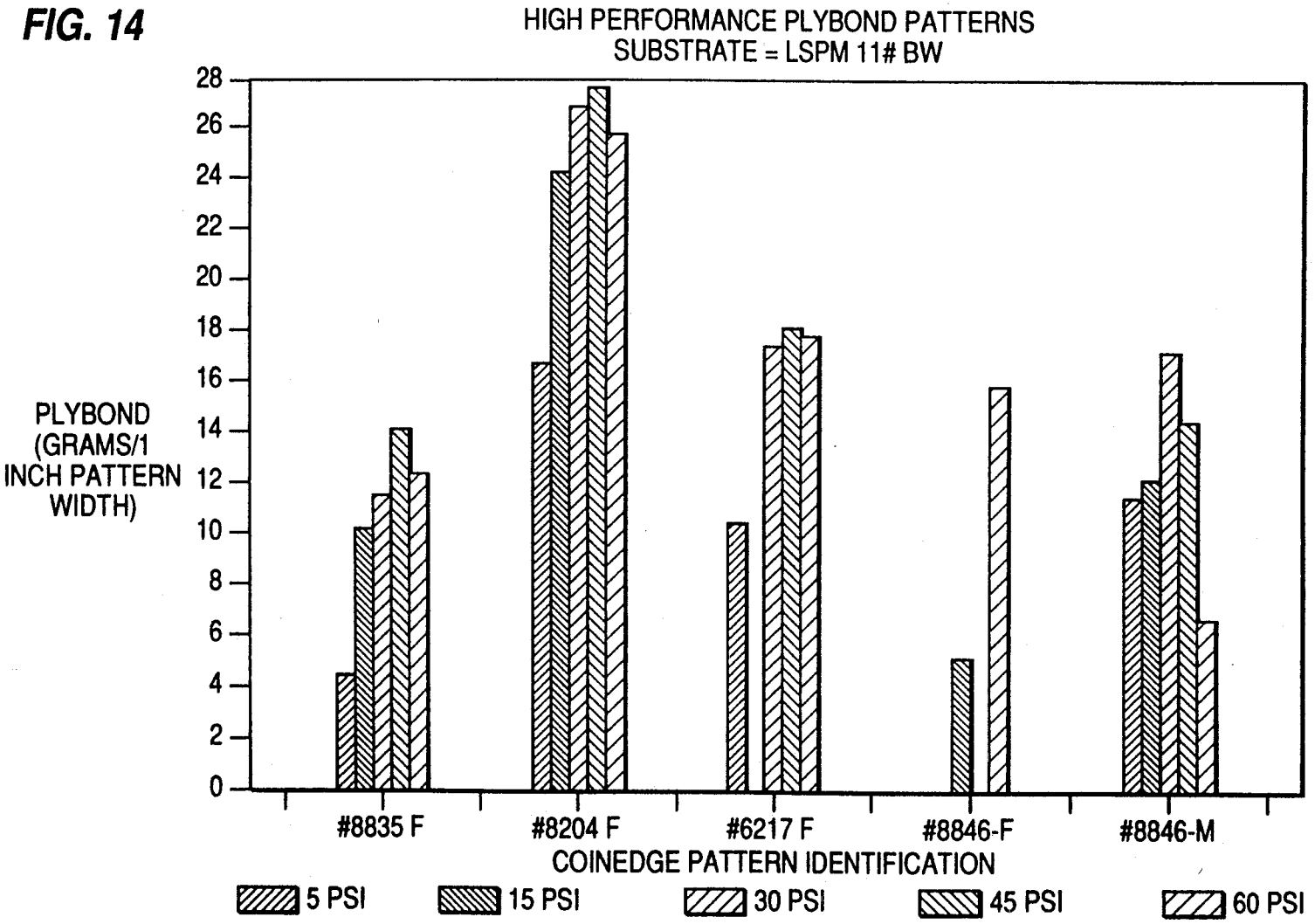

The tests represented by FIG. 14 were performed in the same manner as those whose results are depicted in FIG. 13. In these tests, all engraved patterns were female except for #8846M; both the male and female versions of pattern #8846 were tested as they were in conjunction with FIG. 13. The other difference was the paper substrate used. In the tests for FIG. 13 commercially available Wauna 2-ply paper from James River's Wauna plant was used; in the tests for FIG. 14, paper produced on a laboratory low speed pilot machine (LSPM) was used. Again, FIG. 14 confirms the advantages of the pattern of the invention, #8204. The missing bars for patterns 6217F and 8846F indicate that the samples produced at those pressures for those patterns were not tested for bonding strength.

Figure 15:
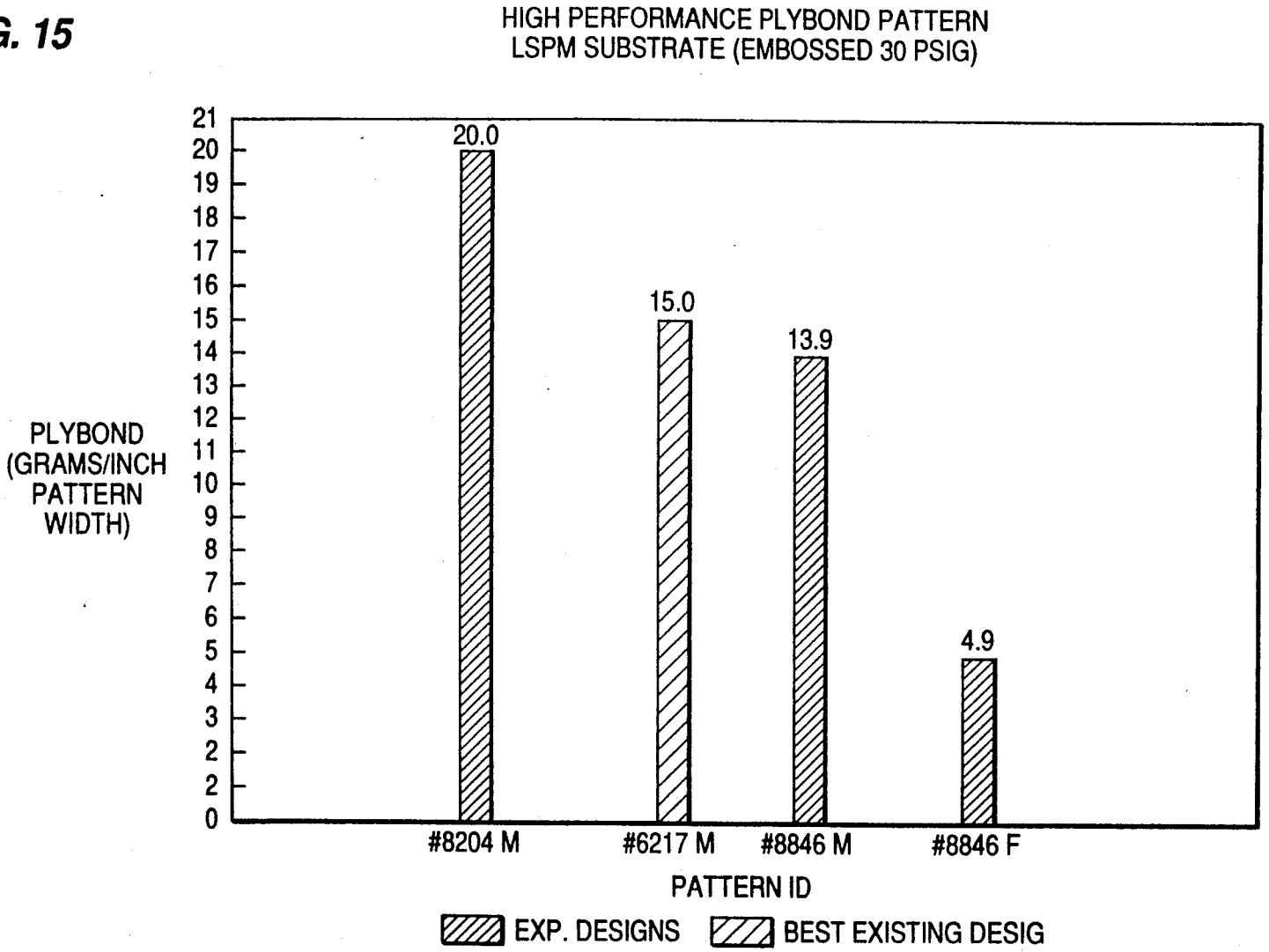

FIG. 15 represents the results of another test performed in the same manner as those related to FIGS. 13 and 14. This test was on LSPM substrate at 30 psi and again illustrates the improvements obtained using the pattern of the invention. The difference between the 30 psi result in FIG. 13 and the results for the same patterns at 30 psi in FIG. 15 represent the effect of different paper substrates. Since the paper will have an effect on the resulting bond, no meaningful conclusion can be reached by comparing test results using different substrates, but, as seen again in FIG. 15, the pattern of the invention is clearly superior to other patterns applied to the same substrate at comparable pressures.

The patterns against which pattern #8204 was compared in FIGS. 12–15 are identified by the pattern number accorded them by their manufacturer, Industrial Engraving Company, Pulaski, Wisconsin. These patterns are available to James River Corporation of Virginia for commercial coin edge embossing.

All of the test data presented in FIGS. 12–15 represent steel engraved patterns used in opposition to an impressionable surface, such as a cotton filled roll. The tests not only demonstrate the superiority of the pattern of the invention, but also demonstrate that the female version provides greater bond strength than the male version of the same pattern (compare #8204F, 30 psi in FIG. 14 with #8204M in FIG. 15). While the reasons for the better bond with the female version is not entirely understood, the way the impressionable surface takes and holds an impressed shape is believed to contribute to the difference.

The embodiment of the invention using cooperating, meshing engraved male and female patterns as depicted in FIG. 3 is currently considered the best mode of the invention, not because it provides significantly better emboss bonds, but because the opposed metal-surfaced roll having a cooperating etched area has a longer useful life and provides more consistent emboss bonds over a longer period than when a roll with an impressionable surface is used.

Figure 16:
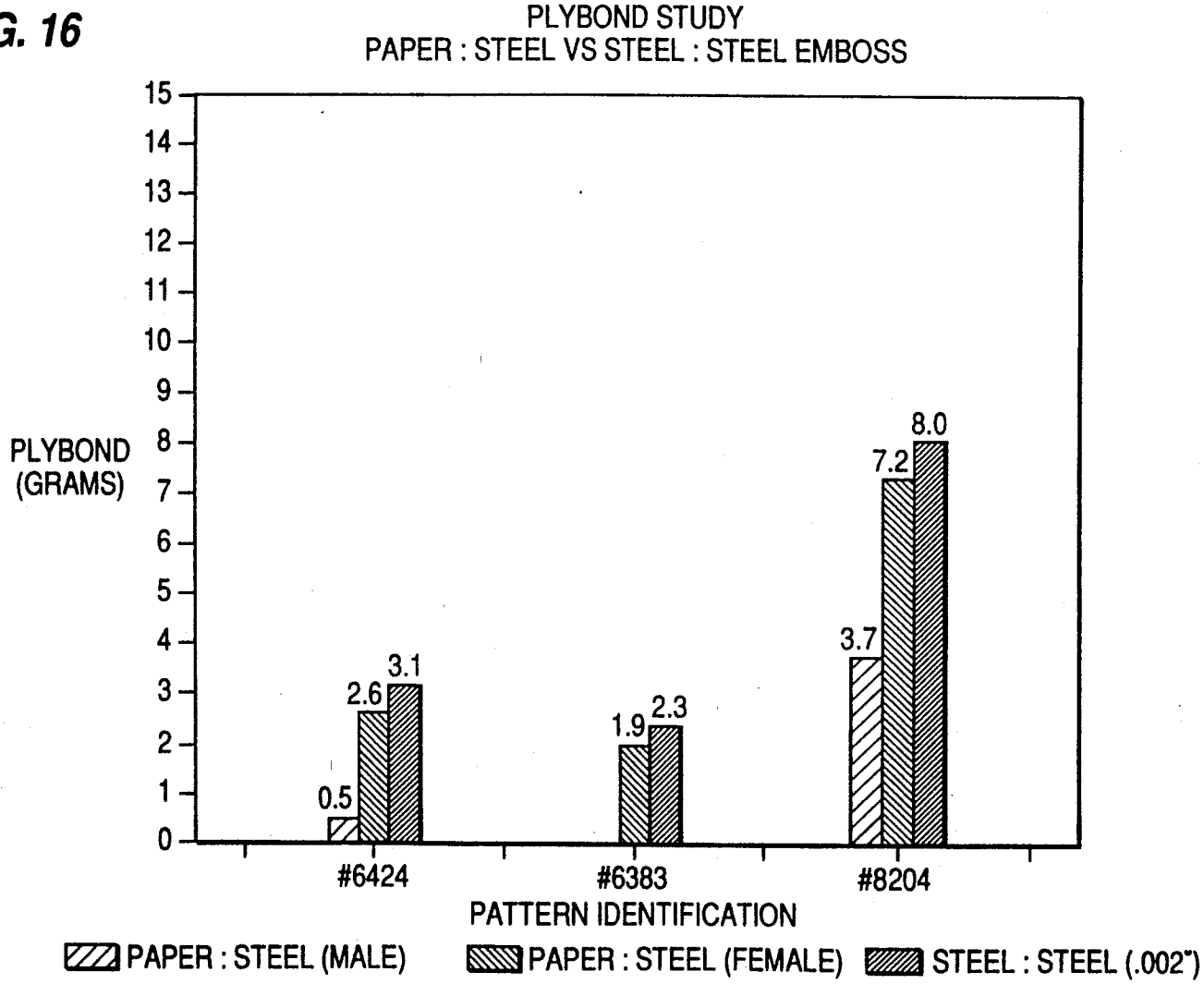

The data depicted in FIG. 16 represents a comparison of the plybond strength of the pattern of the invention (#8204) to other patterns when formed on the same type of substrate by opposed steel rolls with meshing etched areas, a female steel roll in opposition to an impressionable surface, and a male steel roll in opposition to an impressionable surface. For the steel to steel tests, the nip defined by the rolls had a fixed spacing of approximately 0.002". The data demonstrates that the invention provides superior emboss bonding when compared to the other patterns whether formed using an etched steel roll and an impressionable roll surface or opposed steel rolls having meshing etched patterns. As indicated for the pattern of the invention, the plybond performance of steel/steel is not significantly better than female steel/impressionable surface.

The test results clearly demonstrate the benefit of the claimed apparatus and method by providing a superior emboss bond for lightweight cellulosic articles.

It will be apparent to those skilled in the art that various modifications and variations could be made to the apparatus and method of the invention without departing from the scope or spirit of the invention.

What is claimed is:

1. An apparatus for emboss bonding two or more lightweight cellulosic webs to form a multi-ply article, the apparatus comprising:

a pair of rolls disposed for cooperative rotation about parallel cross machine axes and defining a nip between the surfaces thereof, one said roll having a metal surface; and means on the cooperating surfaces of said rolls for forming on webs introduced into said nip an emboss pattern comprising a plurality of truncated right rectangular pyramids projecting from one surface of said webs in aligned adjacent relationship in the machine direction (MD) and the cross machine direction (CD);

wherein said forming means comprises an etched area on the surface of said one roll having predetermined dimensions and comprising a plurality of truncated right rectangular pyramidal cavities in said one roll surface disposed in adjacent CD and MD relationship, each said cavity being defined by an axis coaxial with a radius of said one roll, a base defining an opening in the surface of said one roll, a generally planar apex axially spaced from said base and generally perpendicular to said axis, and sidewalls extending between said base and said apex, said apex having a CD dimension in the range of about 0.025" to about 0.050", a MD dimension in the range of about 0.020" to about 0.050" and a MD/CD dimension ratio of at least about $\frac{2}{3}$, the axial distance between said base and said apex being in the range of about 0.010" to about 0.012", and the sidewalls diverging from said apex at an angle to said axis in the range of about 25° to about 40°.

2. The apparatus of claim 1 wherein the other said roll has an impressionable surface capable of conforming under pressure to said etched area.

3. The apparatus of claim 2 wherein said other roll is a cotton filled emboss roll.

4. The apparatus of claim 1 wherein the other said roll has a metal surface including a cooperating etched area having said predetermined dimensions, the cooperating etched area comprising a plurality of truncated right rectangular pyramids projecting from the surface of the other roll for meshing engagement with the cavities in the surface of said one roll.

5. The apparatus of claim 1 wherein said apex has a CD dimension of about 0.027" and a MD dimension of about 0.02", wherein the axial distance between said apex and said base is about 0.012", wherein the walls diverging from the apex in the CD direction are at an angle to the axis of about 40° and wherein the walls diverging from the apex in the MD direction are at an angle to the axis of about 25° .

6. The apparatus of claim 1 wherein the combined area of the planar apices of said cavities is at least about 30% of the area of said embossed pattern.

7. The apparatus of claim 1 wherein the predetermined dimension of said etched area is selected to form an embossed pattern having an area of at least about 15 square inches per gram of article weight.

8. The apparatus of claim 1 wherein said etched area defines at least one rectangle two parallel sides of which extend circumferentially on the surface of said one roll and two parallel sides of which extend on the surface of said one roll in the cross machine direction.

9. The apparatus of claim 8 wherein the sides of said etched area are disposed to form an embossed bond extending from the edge of said article a distance in the range of about 0.25" to about 1.5".

10. The apparatus of claim 1 wherein said etched area defines two parallel patterns of said cavities spaced about 0.25".

11. An apparatus for emboss bonding two or more lightweight cellulosic webs to form a multi-ply article, the apparatus comprising:

a first cylindrical roll having a metal surface and being disposed for rotation about a cross machine rotation axis;

an etched area of the surface of said first roll defining two parallel patterns spaced from each other about 0.25", each pattern having predetermined dimensions for forming proximate the perimeter of said article an embossed bond, said etched area comprising a plurality of truncated right rectangular pyramidal cavities in said roll surface disposed in adjacent relationship in the machine direction (MD) and cross machine direction (CD); and a second cylindrical roll disposed to cooperatively rotate with said first roll and to define therewith a nip for engaging said webs, said second roll having an impressionable surface capable of conforming under pressure to said etched area.

12. The apparatus of claim 11 wherein each said cavity is defined by an axis coaxial with a radius of said first roll, a base defining an opening in the surface of said first roll, a generally planar apex axially spaced from said base and generally perpendicular to said axis, and sidewalls extending between said base and said apex, said apex having a CD dimension in the range of about 0.025" to about 0.050", a MD dimension in the range of about 0.020" to about 0.050" and a MD/CD dimension ratio of at least about $\frac{2}{3}$, the axial distance between said base and said apex being in the range of about 0.010" to about 0.012", and the sidewalls diverging from said apex at an angle to said axis in the range of about 25° to about 40°.

13. The apparatus of claim 12 wherein said apex has a CD dimension of about 0.027" and a MD dimension of about 0.02", wherein the axial distance between said apex and said base is about 0.012", wherein the walls diverging from the apex in the CD direction are at an angle to the axis of about 40° and wherein the walls diverging from the apex in the MD direction are at an angle to the axis of about 25° .

14. The apparatus of claim 12 wherein the combined area of the planar apices of said cavities is at least about 30% of the area of said embossed bond.

15. The apparatus of claim 11 wherein the predetermined dimension of said pattern is selected to form an embossed bond having an area of at least about 15 square inches per gram of article weight.

16. The apparatus of claim 11 wherein said second roll is a cotton filled emboss roll.

17. The apparatus of claim 11 wherein said pattern defines at least one rectangle two parallel sides of which extend circumferentially on the surface of said first roll and two parallel sides of which extend on the surface of said first roll in the cross machine direction.

18. The apparatus of claim 17 wherein the sides of said pattern are disposed to form an embossed bond extending from the edge of said article a width in the range of about 0.25" to about 1.5".

19. An apparatus for emboss bonding two or more lightweight cellulosic webs to form a multi-ply article, the apparatus comprising:

a pair of cylindrical rolls disposed for cooperative rotation about parallel rotation axes, said rolls defining a nip extending in a cross machine direction (CD) disposed to engage said webs moving in a machine direction (MD), one said roll having an etched area in its surface defining a pattern of predetermined dimensions, said etched area being disposed to cooperatively engage the surface of the other roll to form a embossed bond proximate the perimeter of said article;

the etched area on the surface of said one roll comprising a plurality of truncated right rectangular pyramidal female cavities in said one roll surface disposed in adjacent relationship in the machine and cross machine directions, each said cavity being defined by an axis coaxial with a radius of said one roll, a base defining an opening in the surface of said one roll, a generally planar apex axially spaced from said base and generally perpendicular to said axis, and sidewalls extending between said base and said apex, the apex of each said cavity having a CD dimension in the range of about 0.025" to about 0.050", a MD dimension in the range of about 0.020" to about 0.050", and a MD/CD dimension ratio of at least about $\frac{2}{3}$, the axial distance between said base and said apex being in the range of about 0.010" to about 0.013", and the sidewalls diverging from said apex at an angle to said axis in the range of about 25° to about 40°; and the area on the surface of the other roll corresponding to the etched area on the surface of the one roll comprising a plurality of formed projections having dimensions and dispositions corresponding to said cavities for cooperative meshing therewith.

20. The apparatus of claim 19 wherein the combined area of the apices of said cavities is at least about 30% of the area of said embossed bond.

21. The apparatus of claim 19 wherein the predetermined dimension of said pattern is selected to form an embossed bond having an area of at least about 15 square inches per gram of article weight.

* * * * *